US005487282A

United States Patent [19]

Kühnert

[11] Patent Number: 5,487,282

[45] Date of Patent: Jan. 30, 1996

[54] PROCESS FOR KNITTING TUBULAR FABRIC ON A FLAT BED KNITTING MACHINE

[75] Inventor: Gottfried Kühnert, Aalen, Germany

[73] Assignee: Universal Maschinenfabrik, Westhausen, Germany

[21] Appl. No.: 108,747

[22] PCT Filed: Jan. 31, 1992

[86] PCT No.: PCT/EP92/00212

§ 371 Date: Nov. 1, 1993

§ 102(e) Date: Nov. 1, 1993

[87] PCT Pub. No.: WO92/15739

PCT Pub. Date: Jul. 17, 1992

[30] Foreign Application Priority Data

Mar. 7, 1991 [DE] Germany ..... 41 07 316.9

[51] Int. Cl.[6] ..... D04B 1/22

[52] U.S. Cl. ..... 66/69; 66/174

[58] Field of Search ..... 66/69, 70, 174, 66/176

[56] References Cited

U.S. PATENT DOCUMENTS

| | | | |
|---|---|---|---|
| 3,664,156 | 5/1972 | Betts et al. | 66/176 |
| 3,668,901 | 6/1972 | Betts et al. | 66/176 |
| 3,695,063 | 10/1972 | Betts et al. | 66/176 |
| 3,796,068 | 3/1974 | Betts et al. | 66/176 |
| 3,813,901 | 6/1974 | Betts et al. | 66/176 X |
| 3,824,810 | 7/1974 | Betts et al. | 66/176 X |
| 4,905,483 | 3/1990 | Shima | 66/69 X |

FOREIGN PATENT DOCUMENTS

| | | | |
|---|---|---|---|
| 2228750 | 9/1990 | United Kingdom | 66/69 |

*Primary Examiner*—John J. Calvert
*Attorney, Agent, or Firm*—Limbach & Limbach

[57] ABSTRACT

A process for knitting tubular fabric on a straight knitting machine having two main needle beds, two auxiliary needle beds and a racking device. An edge stitch is transferred from each main needle bed to respective auxiliary needles beds, the needle beds are racked with respect to each other, the stitch is transferred back to the main needle beds and then knitted.

10 Claims, 3 Drawing Sheets

PROCESS FOR KNITTING TUBULAR FABRIC ON A FLAT BED KNITTING MACHINE

FIELD OF THE INVENTION

The description relates to a process for knitting tubular fabric on a flat bed knitting machine having two main and two auxiliary needle beds as well as a racking device.

BACKGROUND OF THE INVENTION

Processes of this type are known for example from the DE 16 35 965 A1 or the DE 24 36 450 A1 which originate from the same inventor as the subject matter of the present patent. Knitted goods and knitted sections in tubular form, such as pullover body sections or pullover arms for example, which were connected and stitched together during further finishing steps, were knitted on the flat bed knitting machines described therein. It was not possible with the conventional processes to produce, in particular, closed finished fabrics on flat bed machines at low cost and thus in an economical manner or to carry out bind-off processes on flat bed knitting machines. A binding-off or reducing of the tube, perhaps for creating the shoulder parts, was basically possible of course, but, due to being uneconomical, it was not therefore utilised in practice or at least only to a limited extent because coarsely ridged linking seams occurred in the finished fabric, approximately in the shoulder region, which was both aesthetically displeasing and disadvantageous when wearing the article of clothing. Conventional binding-off processes not using auxiliary needle beds are known for example from the DE 32 03 028 A1, in which a transfer process from the front to the rear needle bed or vice versa is carried out, wherein more than one stitch is made to lie on a knitting needle by means of corresponding racking, and this needle is then knitted.

A process for knitting tubular fabrics and for reducing the article knitted in tubular form is known from the DE 40 06 877 A1, wherein auxiliary needle beds are likewise utilised. Therein, all the stitches are transferred from one auxiliary needle bed to the needle bed associated with the other auxiliary needle bed and thereafter they are re-transferred. Thereby, a racking occurs on the one hand between the respective rear main and auxiliary needle bed, which are not displaced relative to each other and between the front main and auxiliary needle bed, which are likewise not displaced relative to each other, on the other.

All of these known processes bear the disadvantage that the binding-off regions exhibit ridges which is both very detrimental to the aesthetic effect of the article of clothing, perhaps a pullover or a knitted dress, and moreover, is disadvantageous for the wearer of the clothing.

SUMMARY AND OBJECTS OF THE INVENTION

The object of the invention therefore is to develop a process which does not have the disadvantages of the conventional binding-off processes and which enables knitted goods to be produced in a simple manner on flat bed knitting machines and that allows non-wearing flat bindings of the front and rear sides of the goods without the formation of ridges.

Starting from the process mentioned hereinabove, this object is achieved in accordance with the invention in that, for the formation of a finished fabric, an edge stitch is transferred on each occasion from one main needle bed to an auxiliary needle bed, these beds are sacked together, the stitches are transferred back from the auxiliary needle bed to the main needle bed and the needle carrying the re-transferred stitch is knitted-off.

This process for the reducing of tubular fabrics leads to bindings or reductions e.g. for finishings in the shoulder region of pullovers or articles of clothing that are to be completely knitted on flat bed knitting machines, wherein areas such as ridges etc that are liable to wear do not occur. The articles of clothing manufactured in this manner are thus elegant and comfortable to wear.

The process in accordance with the invention is particularly advantageous for articles of clothing which are to be completely finished on the flat bed knitting machine such as is described for example in the not pre-published DE 39 31 414 A1 from the same inventor. With the aid of the process in accordance with the invention, it is possible, for such kinds of complete or ready-made articles of clothing such as complete pullovers or ready-made dresses for example, to produce, in a single operation on the flat bed knitting machine, a tubular binding-off seam on a flat bed knitting machine without having wear-patches or ridges for the tubular finishings, for example in the shoulder region.

Advantageous embodiments of the invention are specified in the appended claims.

In dependence on the amount of reducing that is to be done, the process according to the invention is repeated in accordance with the number of stitches that are to be finished.

Preferably, the transfer of the edge stitches occurs on the one hand between the respective front main and auxiliary needle bed and on the other hand between the respective rear main and auxiliary needle bed. However, in dependence on the particular requirements and desired knitting pattern, it is possible to transfer the edge stitches on the one hand between the respective front main and rear auxiliary needle bed and on the other hand between the respective rear main and front auxiliary needle bed or else, if necessary, to effect these things alternately or mixed together.

In accordance with a particularly advantageous embodiment of the invention, following the re-transfer onto the main needle bed, the edge stitches are knitted-off simultaneously on the latter by a yarn guide. Due to the fact that there is only one yarn guide, there results a closed tube finish.

Alternatively, in accordance with an alternative embodiment of the process in accordance with the invention for the production of an open tube finish, it is provided that, following the re-transfer onto the main needle bed, the edge stitches are knitted separately on the respective front and rear main needle bed by different yarn guides. In this manner, it is possible to obtain elegant neck regions i.e. an open tube finish, for articles of clothing e.g. for complete pullovers or dresses that are knitted as a whole on the flat bed knitting machine. Thus, for the production of complete articles of clothing on flat bed knitting machines, the binding-off process in accordance with the invention for a closed tube finish can be utilised initially for binding-off in the shoulder region and thereafter the binding-off process for an open tube finish can be utilised.

For increased productivity of the machines, it is particularly advantageous if the edge stitches are knitted-off firstly on the rear main needle bed and then on the front main needle bed, or vice versa. For this, carriages having at least two knitting cams are required.

A further increase in machine productivity also arises in that, following the knitting process, the edge stitches are thereafter transferred. For this, flat bed knitting machines having carriages that are provided with transfer cams in addition to the knitting cams are required.

A particularly advantageous embodiment of the invention exhibits the following method steps:

a) the current edge stitch on the main needle bed is transferred to the currently associated auxiliary needle bed;

b) the auxiliary needle beds are racked by one needle in the direction of the adjacent needle of the main needle bed;

c) the current edge stitch which was transferred to the auxiliary needle bed is transferred back to the current main needle bed so that the edge stitch is located on one needle of the main needle bed together with the stitch adjacent to the edge stitch and d) the two needles of the two main needle beds are knitted with the currently re-transferred edge stitches.

The process in accordance with the invention for producing a finished fabric or for the process of reducing may be effected on the flat bed knitting machine either from left to right in accordance with the embodiment described hereinafter or else from right to left. However, it is equally possible to carry out the process of reducing and binding-off in accordance with the invention simultaneously from left to right and from right to left i.e. simultaneously from out to in. In this case, there must be provided one yarn guide on each side of the flat bed knitting machine for binding-off for a closed tube finish and there have to be two yarn guides on the two sides of the knitted fabric present on the flat bed knitting machine for binding-off for an open tube finish.

The invention will be explained in detail hereinafter on the basis of the operating regions depicted in the FIGS. 1 and 2.

DETAILED DESCRIPTION OF THE INVENTION

The individual successively occurring process steps will be explained with the help of the FIGS. 1*a* to 1*i* and 2*a* to 2*i*. In these Figures, the front main needle bed is referenced A, the front auxiliary needle bed a, the rear main needle bed B and the rear auxiliary needle bed b. The individual needles of the needle beds are numbered continuously from left to right. For the sake of simplicity in the embodiment illustrated, only 10 stitches or needles per needle bed are depicted. Self evidently, one can have knitwear incorporating more than 10 stitches.

The current position of the carriage is indicated symbolically in the Figures by a large, downwardly directed arrow.

To begin with, the knitting sequence for an embodiment for the binding-off for a closed tube finish in accordance with the invention will be explained with the help of the FIG. 1.

FIG. 1 illustrates the last "round" of the tubular fabric, for example a pullover, before the binding-off or the reducing in the shoulder region begins. It is assumed that the carriage is located on the left hand side as illustrated.

During the next movement of the carriage to the right, the left edge stitch, which is located on the needle 1 of the front needle bed A is transferred to the needle 1 of the front auxiliary needle bed a and also the stitch located on the needle 1 of the rear main needle bed B is transferred to the needle 1 of the rear auxiliary needle bed b. The carriage is now located on the right hand side of the knitting (FIG. 1*b*). In this position, i.e. during the carriage return at the right hand side, the front auxiliary needle bed a and the rear auxiliary needle bed b are racked by one needle to the right as is shown in FIG. 1*c*. The carriage continues to be located to the right of the knitting.

During the movement of the carriage from right to left, the stitch located on the needle 1 of the front auxiliary needle bed a is re-transferred to the needle 2 of the front main needle bed A and the stitch located on the needle 1 of the rear auxiliary needle bed b is re-transferred to the needle 2 of the rear main needle bed B. Thereafter, the carriage is located on the left hand side of the knitting (FIG. 1*d*). In this left hand return position, the auxiliary needle beds a, b are returned into the basic position as is illustrated in FIG. 1*e*. As is also schematically illustrated in FIG. 1*e*, the double edge stitches located on the needles 2 of the main needle beds A and B are knitted during the movement of the carriage to the right. Thereafter, the carriage is located on the right hand side of the knitting. The yarn guide FF was thereby transported to the right hand side of the left edge stitches.

Figure 1A:
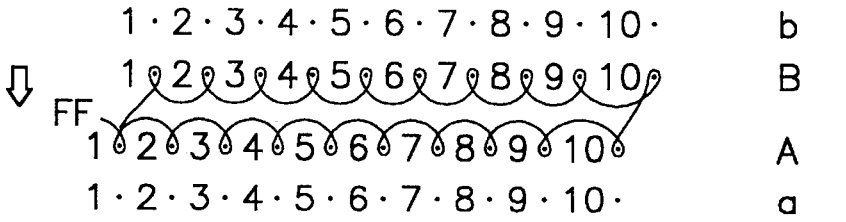
FIG. 1 shows the process steps for binding-off with a closed tube finish and FIG. 2 the process steps for binding-off with an open tube finish.
Figure 1B:
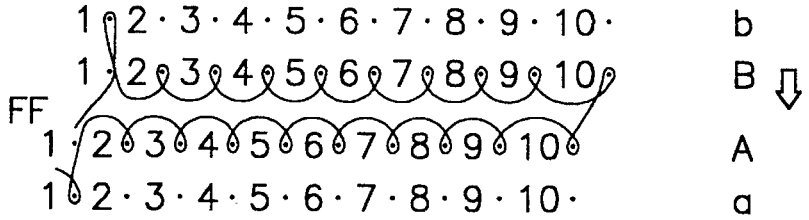
Figure 1C:
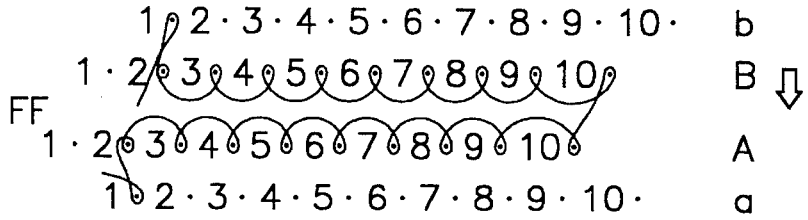
Figure 1D:
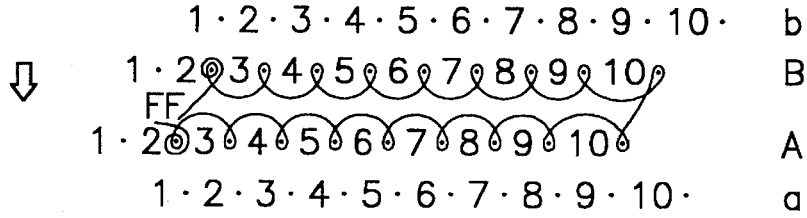
Figure 1E:
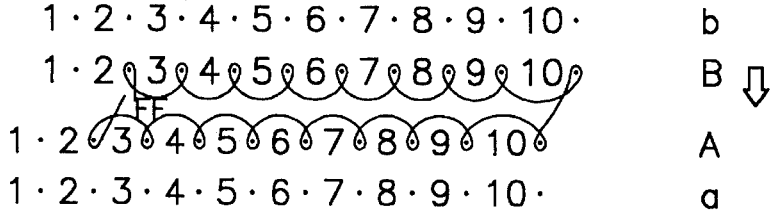
Figure 1F:
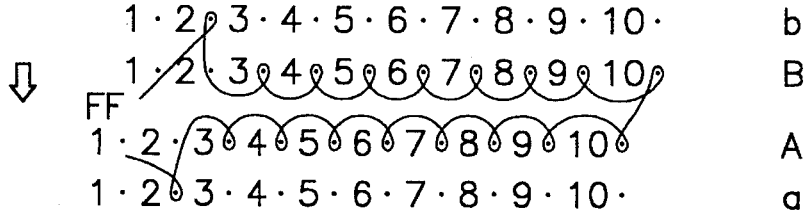
Figure 1G:
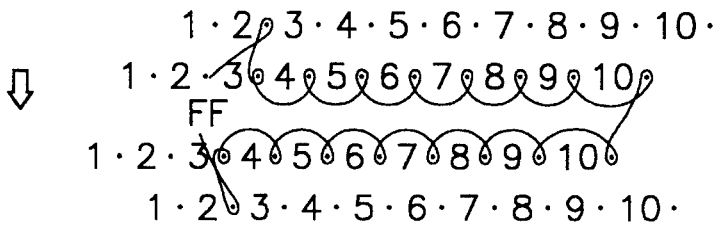
Figure 1H:
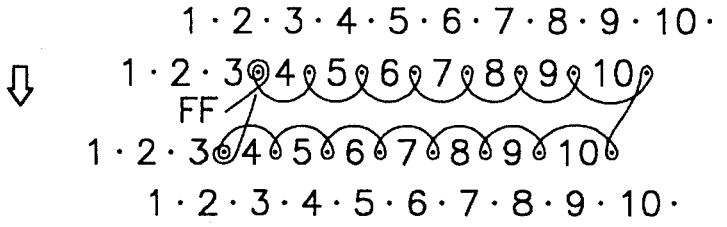
Figure 1I:
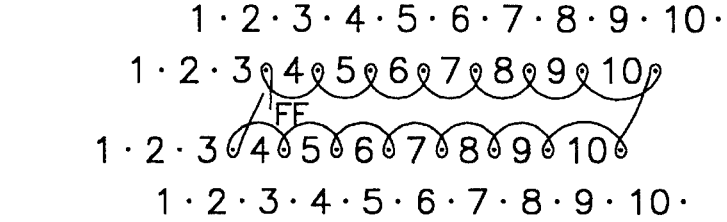

As is illustrated in FIG. 1*f*, the yarn guide FF is transported on the left hand side of the left edge stitches during the movement of the carriage from right to left and, at the same time, the left edge stitches are respectively transferred from the needles 2 of the front and rear main needle bed A and B to the needles 2 of the front and rear auxiliary needle bed a and b. In this position of the carriage and the yarn guide FF, there is effected a racking of the auxiliary needle beds a and b by one needle pitch to the right (c.f. 1*g*) so that the stitches lying on the needles 2 of the auxiliary needle bed a and b are re-transferred to the needles 3 of the main needle beds A and B when the carriage is moved from left to right. If—as is the case in the present embodiment—the carriage has a knitting cam following the transfer cam, the double stitches located on the needles 3 of the main needle bed A and B are knitted following the transfer while the carriage is moving to the right. Thereafter, the yarn guide is located once more on the right of the left edge stitches and the carriage is again on the right hand side of the knitting as is illustrated in FIG. 1*i*.

After the auxiliary needle beds a, b have been displaced back again corresponding to the remarks relating to FIG. 1*e*, the process steps a, b run their course once more as was previously described with the aid of the FIGS. 1*f* to 1*i*.

The process is repeated until such time as the tube finishing is ended in accordance with the particular requirements.

It is pointed out that the yarn guide FF is only transported over the area of the edge stitches during the process steps and also that it is only the edge stitches, and not the other stitches, which are knitted. It is also pointed out that there is a reducing in only one direction, in the embodiment illustrated then, only from left to right but not from right to left, whereby the front and rear edge stitches are simultaneously knitted in one movement of the carriage as is the case for the right-right knitting process. In addition, only ever one front and one rear edge stitch is transferred before the knitting process on the current main needle bed A and B.

Although in the illustrated embodiment, the knitting process occurs from left to right, the knitting process could also of course, always be carried out from right to left i.e. the reducing takes place on the right hand side of the knitting. It is equally possible in accordance with the knitting sequence described, to reduce or bind-off the knitting simultaneously both from the left as well as from the right, whereby the knitting is always knitted from left to right for the left hand side of the knitting process, and always from right to left for the right hand side of the binding-off process. In this case, a further yarn guide is also provided for the right hand region of the knitting.

An embodiment of the invention using the example of the binding-off for an open tube finish is described in the process steps schematically illustrated in FIG. 2. The symbols and representations of the needles and the main and auxiliary needle beds A, B and a, b correspond to those of FIG. 1.

During the binding-off of a ready-made article of clothing, a complete pullover or a complete knitted dress for example, the shoulder region corresponds to the binding-off for a closed tube finish as is illustrated in FIG. 1. For the neck region, a binding-off with an open tube finish is required as is schematically illustrated hereinafter.

Figure 2A:
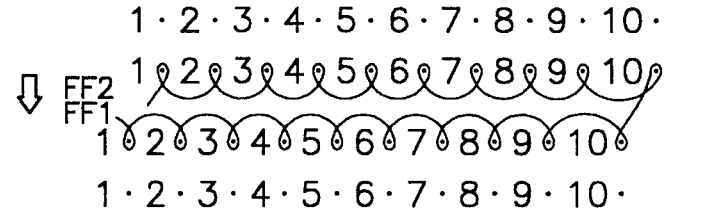
Figure 2B:
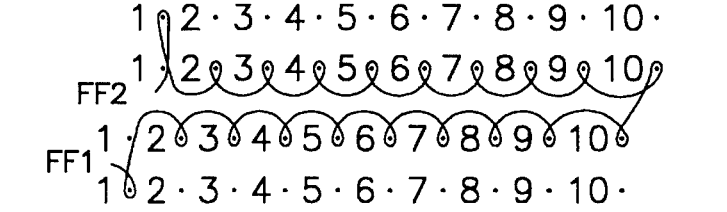

In correspondence with FIG. 1*a*, FIG. 2*a* likewise illustrates the last "round" of the tube before the binding-off for an open tube finish. It is assumed that the carriage and also the yarn guide FF1 for the front main needle bed A and the yarn guide FF2 for the rear main needle bed B are located on the left hand side of the knitting as is schematically indicated in FIG. 2*a*. During the movement of the carriage from left to right, the edge stitches, namely the stitches on the needles 1 of the main needle bed A and B are transferred onto the needles 1 of the auxiliary needle beds a and b (c.f. FIG. 2*b*).

Figure 2C:
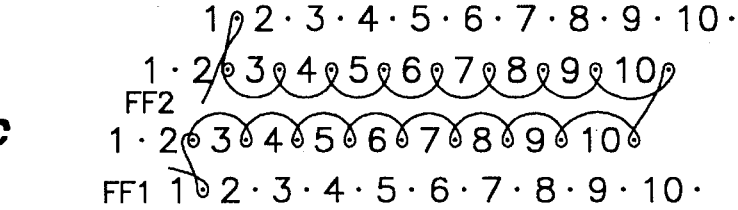
Figure 2D:
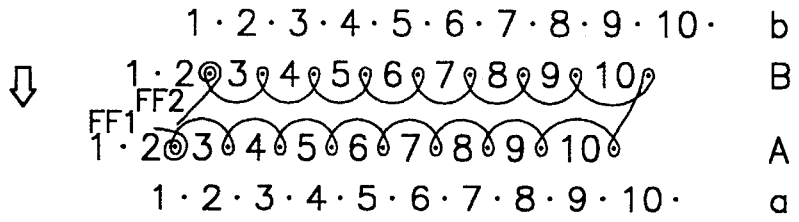
Figure 2E:
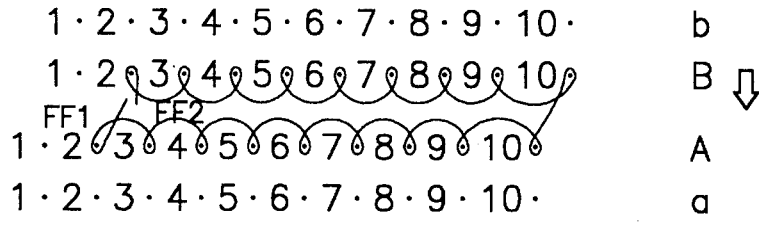
Figure 2F:
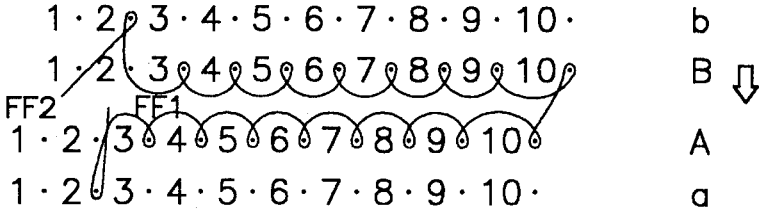
Figure 2G:
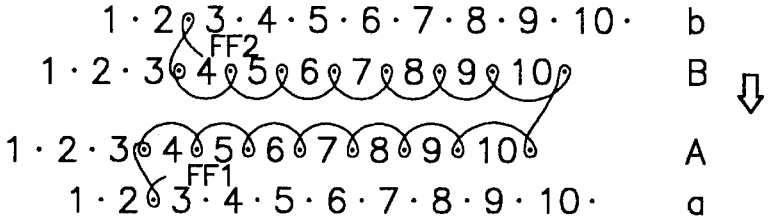
Figure 2H:
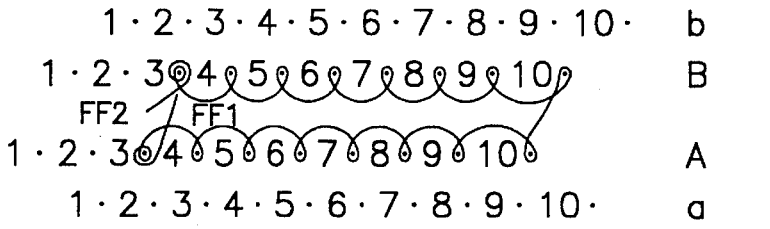

When the carriage is located in the right hand side return position, the needle beds a and b are racked to the right by one needle pitch (c.f. FIG. 2*c*) so that during the subsequent movement of the carriage from right to left, the stitches are transferred from the auxiliary needle beds a and b onto the needles 2 of the main needle beds A and B (c.f. FIG. 2*d*). Thereafter, when the carriage is located in the left hand return position, the auxiliary needle beds a and b are returned into the basic position as is schematically illustrated in FIG. 2*e*. The carriage then runs to the right and knits the needles 2 of the front main needle bed A with the yarn guide FF1 and the needles 2 of the rear main needle bed B with the yarn guide FF2. There thus results both at the front and the rear a linking or edge stitch. After the knitting, the yarn guides FF1 and FF2 are located on the right of the edge stitches. In the present example, the carriage has been provided with transfer cams in addition to the knitting cams. During the movement of the carriage to the right during which the edge stitches are knitted, the edge stitches are then transferred, following the knitting, from the needles 2 of the main needle beds A and B onto the needles 2 of the auxiliary needle beds a and b associated with the main needle beds A and B (c.f. FIG. 2*f*). As FIG. 2*g* shows, the auxiliary needle beds a and b are racked to the right by one needle pitch and, during the movement of the carriage from right to left, the stitch on the needle 2 of the front auxiliary needle bed a is transferred onto the needle 3 of the front main needle bed A and the stitch on the needle 2 of the rear auxiliary needle bed b is transferred onto the needle 3 of the rear main needle bed B in accordance with FIG. 2*h* so that two stitches hang on the needles 3 of the main needle bed A and B. During the movement of the carriage from right to left, the yarn guides FF1 and FF2 are transported to the left hand side of the edge stitches.

When the carriage is located in its return position left of the knitting (FIG. 2*h*), the auxiliary needle beds a and b are racked to the left by one needle pitch into the basic position. Thereafter, the carriage moves to the right and knits the needles 3 of the main needle beds A and B so that, as edge stitches, there then ensues a respective linking stitch. The yarn guides FF1 and FF2 are now located on the right of the edge stitches and the carriage is located on the right hand side of the knitting ( FIG. 2*i*).

Figure 2I:
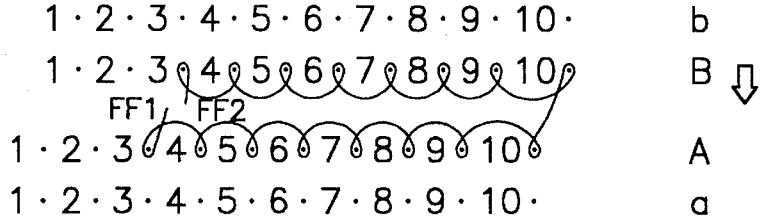

As FIG. 2*i* shows, the knitting sequence is once more in the state already described in connection with FIG. 2*e* with the sole difference that the edge stitches are now located on the needles 3 of the main needle beds A and B instead of on the needles 2. The process described is repeated accordingly, in dependence on the number of stitches that have to be hooked up.

The invention has been described in terms of preferred embodiments. However numerous configurations and modifications of these embodiments are possible for the skilled man without thereby departing from the spirit of the invention. For example, the processes for binding-off for closed and open tube finishes can be carried out successively so that the shoulder parts and the neck parts required for the production of complete articles of clothing such as ready-made pullovers or complete knitted dresses can be carried out in a simple and productive manner in a single operation on a flat bed knitting machine.

I claim:

1. A process for knitting a tubular fabric on a flat bed knitting machine having two main needle beds, two auxiliary needle beds each corresponding to a respective main needle bed, and a racking device, comprising the steps of:

transferring an edge stitch from a first needle on a first main needle bed to a first needle on a first auxiliary needle bed;

racking the first auxiliary needle bed with respect to its corresponding main needle bed;

transferring the stitch from the first needle on the first auxiliary needle bed to a second needle on the first main needle bed; and knitting the second needle on the first main needle bed.

2. A process in accordance with claim 1, wherein the first transferring step occurs between corresponding main and auxiliary needle beds and the second transferring step occurs between corresponding main and auxiliary needle beds.

3. A process in accordance with claim 1, wherein the first transferring step occurs between non-corresponding main and auxiliary needle beds and the second transferring step occurs between non-corresponding main and auxiliary needle beds.

4. A process in accordance with claim 1, wherein the knitting step is carried out simultaneously on each main needle bed by a yarn guide.

5. A process in accordance with claim 1, wherein the knitting step is carried out separately on each main needle bed by separate yarn guides.

6. A process in accordance with claim 1, wherein the knitting step is carried out first on one main needle bed and then on the other main needle bed.

7. A process in accordance with claim 1, wherein auxiliary needle beds are racked by one needle pitch in the direction of the second needle of the first needle bed, said second needle of the first needle bed being adjacent to the first needle of the main needle bed.

8. A process in accordance with claim 1, wherein the auxiliary needle beds are moved back to their starting position and the steps are repeated in accordance with the number of stitches that are to be knitted.

9. A process in accordance with claim 1, wherein the steps are performed simultaneously from left to right and from right to left.

10. A process for knitting a tubular fabric on a flat bed knitting machine having a pair of main needle beds, a pair of auxiliary needle beds each one corresponding to one of the main needle beds, and a racking device, comprising the sequential steps of:

a. transferring a stitch from one needle on the main needle bed to a corresponding needle on the auxiliary needle bed;

b. racking the auxiliary needle bed with respect to the main needle bed;

c. transferring the stitch from the auxiliary needle bed back to a next needle on the main needle bed, wherein the next needle is adjacent to the one needle;

d. knitting the one and next needles on the main needle bed; and e. repeating steps a through d as required.

* * * * *